United States Patent [19]

Wurst et al.

[11] 3,977,338

[45] Aug. 31, 1976

[54] FEED REVERSING ARRANGEMENT FOR SEWING MACHINES

[75] Inventors: John W. Wurst, Dover; Stephen A. Garron, Elizabeth, both of N.J.

[73] Assignee: The Singer Company, New York, N.Y.

[22] Filed: May 21, 1975

[21] Appl. No.: 579,511

[52] U.S. Cl. ..... 112/210; 112/158 E; 112/121.11

[51] Int. Cl.[2] ..... D05B 27/00; D05B 3/02

[58] Field of Search ..... 112/210, 205, 121.11, 112/121.12, 2, 158 E; 235/151.11; 340/172.5

[56] References Cited

UNITED STATES PATENTS

| | | | |
|---|---|---|---|
| 3,005,136 | 10/1961 | Fluckiger | 112/158 E X |
| 3,654,882 | 4/1972 | Kamena | 112/121.11 |
| 3,752,098 | 8/1973 | Logan | 112/121.12 |
| 3,872,808 | 5/1975 | Wurst | 112/158 E |
| 3,889,105 | 6/1975 | Schneekloth | 235/151.11 |

*Primary Examiner*—Werner H. Schroeder
*Assistant Examiner*—Peter Nerbun
*Attorney, Agent, or Firm*—Edward L. Bell; Robert E. Smith; Julian Falk

[57] ABSTRACT

A sewing machine is disclosed in which the pattern of successive needle penetrations during stitching is influenced in accordance with pattern information stored within the machine in a static memory. This pattern information is retrieved and utilized electronically to control, among other factors, the magnitude and direction of feed of the work fabric being stitched. Manually operable electric feed reversing switch means is provided which is effective, while it remains closed, to interrupt utilization of this pattern information to the stitch forming instrumentalities both as to needle bight and work feed motion and to substitute in its place information from auxiliary static memory for use electronically to influence uniform work feed in a reverse direction with the needle maintained in one predetermined lateral position. Provision is also made upon each reopening of the feed reversing switch for reinstating the beginning of that particular pattern of stitches which had been interrupted regardless of where during the course of sewing that stitch pattern the feed reversing switch may have been closed.

4 Claims, 4 Drawing Figures

Fig. 1
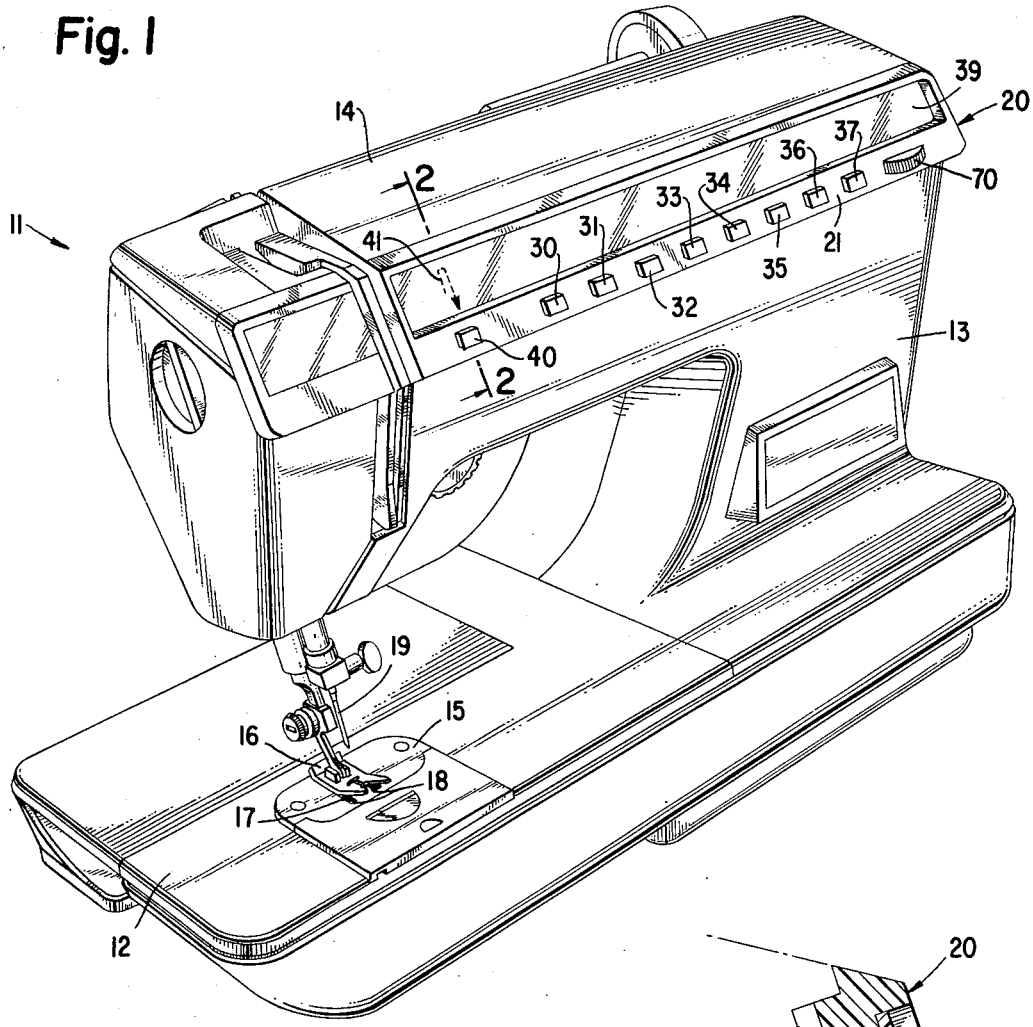
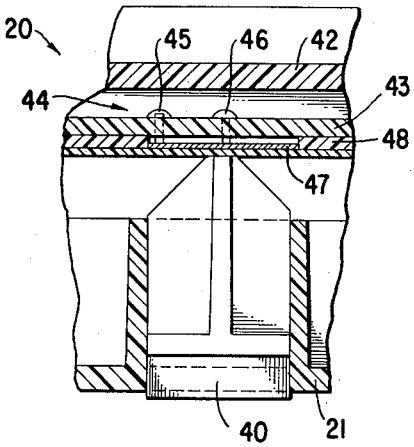
Fig. 3
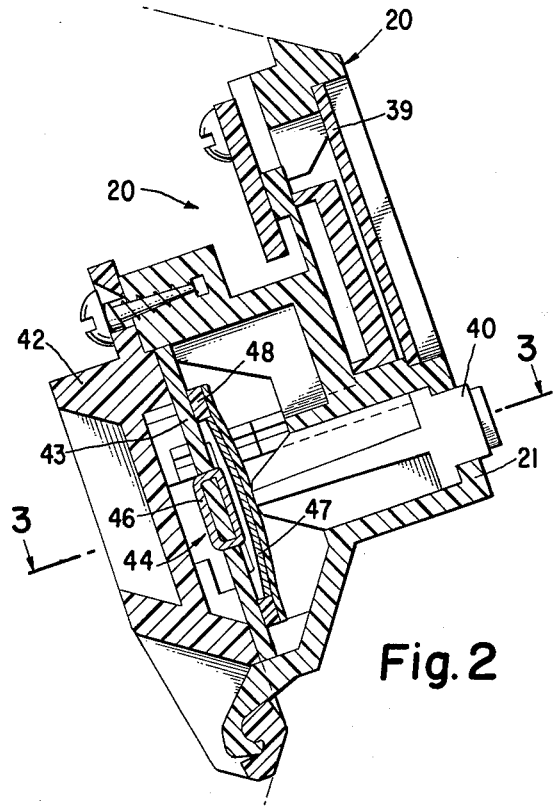
Fig. 2

FEED REVERSING ARRANGEMENT FOR SEWING MACHINES

BACKGROUND OF THE INVENTION

It is known in the sewing machine art to provide mechanical feed reversing devices which physically shift the feed regulating mechanism into a position for reverse feeding.

Special purpose devices such as buttonholing mechanisms for sewing machines are also known in which the feed is reversed at the same time that the needle jogging mechanism is set for the sewing of the stitches at one side. These known special purpose mechanisms are complicated and costly devices and they are not adapted for general use in backtacking or reverse stitching.

SUMMARY OF THE INVENTION

The present invention provides an arrangement for providing on command of the operator a predetermined stitch configuration such as straight stitching in reverse directions of feed for a sewing machine in which the stitch configuration is influenced by an ornamental stitch pattern system operating in response to electronic pattern information signals. It is an object of this invention to provide such predetermined stitch configuration in a sewing machine of the above character making use of the same ornamental stitch pattern system during operation in the predetermined stitch configuration as during normal pattern sewing. This object is attained by the provision of a manually operated electric switch means which is effective to substitute one predetermined set of electronic bight and feed dictating information signals in place of the electronic pattern information signals as the input to the ornamental stitch pattern of the sewing machine.

In a preferred form of this invention, closure of a feed reversing electric switch means not only impresses electronic signals dictating operation of the work feeding mechanism in a reverse direction, but also interrupts or prevents both the electronic needle bight and work feed pattern information signals from being applied to the ornamental stitch pattern system of the sewing machine. Moreover, in the preferred embodiment, means are provided effective for each reopening of the feed reversing electric switch for reinstating the electronic pattern information signals corresponding to the first stitch of that pattern of stitches which had been interrupted.

DESCRIPTION OF THE DRAWINGS

The accompanying drawings illustrate a preferred form of this invention in which:

FIG. 1 is a front perspective view of a sewing machine to which this invention has been applied;

FIG. 2 is an enlarged transverse cross sectional view taken substantially along line 2—2 of FIG. 1 showing the feed reversing switch on the sewing machine;

FIG. 3 is a longitudinal cross sectional view through the feed reversing switch taken substantially along line 3—3 of FIG. 2.

DESCRIPTION OF THE PREFERRED EMBODIMENT

Figure 4:
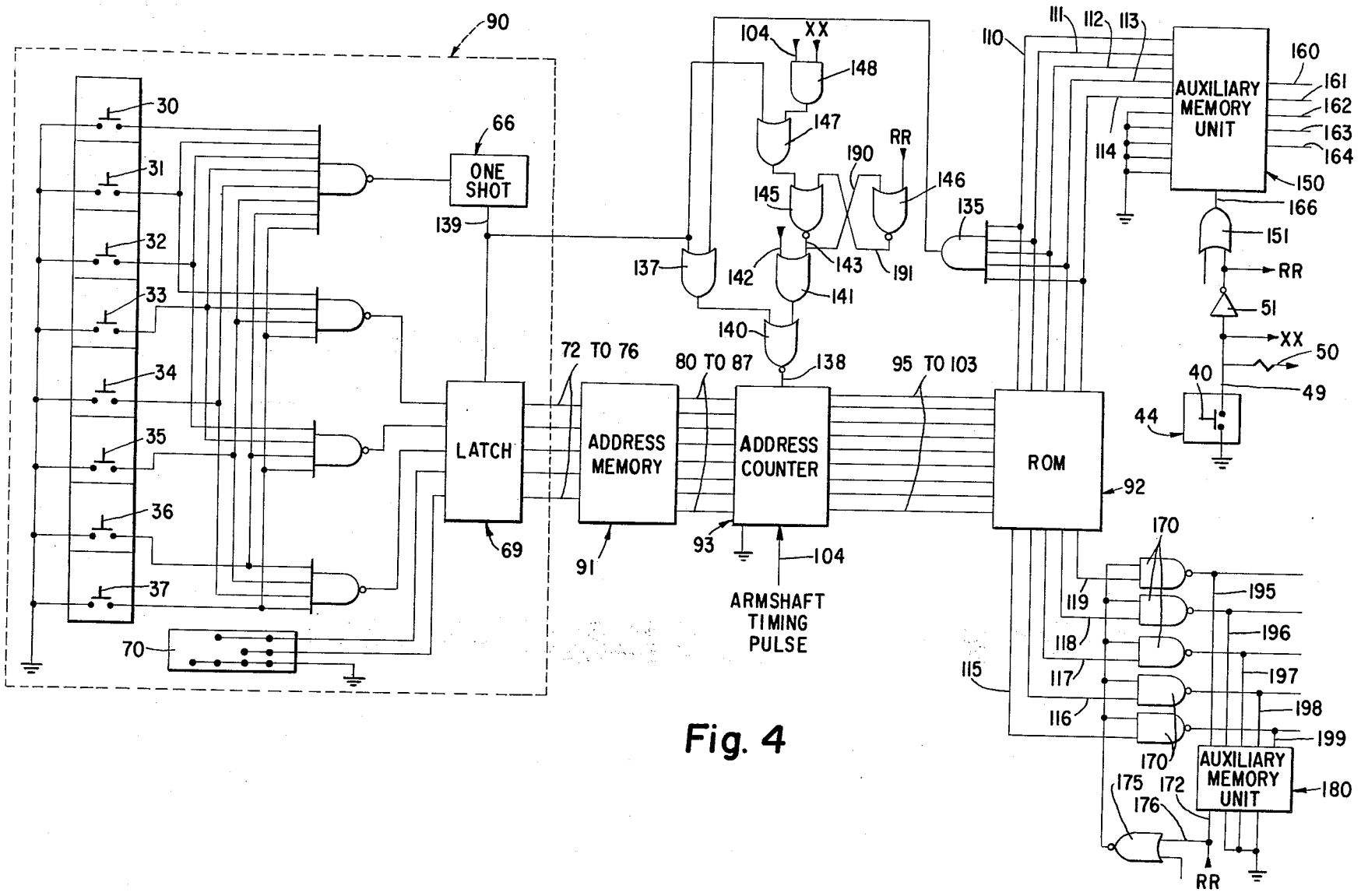
FIG. 4 is a transistor-to-transistor logic diagram showing an ornamental sewing machine stitch pattern system operative in response to electronic pattern information signals to which the feed reversing arrangement of this invention is applied.

This invention is adapted to be applied to any sewing machine having an ornamental stitch pattern system operating in response to electronic pattern information signals. The U.S. Pat. No. 3,872,808, Mar. 25, 1975 of John W. Wurst which discloses one sewing machine of this type is incorporated herein by reference. In the preferred embodiment illustrated in the accompanying drawings, this invention is illustrated as a feed reversing mechanism, however, it will be appreciated that any other predetermined stitch configuration may be utilized.

The logic diagram illustrated in FIG. 4 includes each of the elements disclosed in FIG. 2 of the U.S. Pat. No. 3,872,808 referred to above and in addition includes additional elements to provide for a greater selection of patterns as well as additional elements in order to provide for the feed reversing arrangement of this invention. Comparison of these figures may assist in an understanding of the present invention, bearing in mind that the U.S. Pat. No. 3,872,808 does not disclose any manually operative means for influencing a uniform work feed in a reverse direction.

Referring to FIG. 1 of the drawings, 11 indicates a sewing machine frame including a work supporting bed 12 from which rises a standard 13 which sustains a bracket arm 14 overhanging the bed. A throat plate 15 carried on the bed supports the thrust of a spring loaded presser device 16 carried in the bracket arm. Work fabrics to be stitched are urged by the presser device 16 downwardly against the throat plate and against a work feed dog 17 which works upwardly through slots 18 in the throat plate to feed the work. While any known sewing machine work feeding mechanism may be employed, that disclosed in the U.S. Pat. No. 3,872,808 incorporated herein is a preferred form. The throat plate 15 is also apertured to accommodate reciprocation of a needle 19 carried in the bracket arm.

The bracket arm of the sewing machine is preferably fitted with a control assembly 20 which may be constructed in accordance with that disclosed in the U.S. Pat. application Ser. No. 527,314 of Adams, et al., filed Nov. 26, 1974 which is incorporated herein by reference. Preferably, the control assembly includes an escutcheon plate 21 through which a plurality of pattern selection buttons 30 to 37 protrude, and a transparent insert 39 through which indicia in close association with the selector buttons is visible. An additional button 40 is provided shiftably supported to protrude through the escutcheon plate 21 for the purpose of manually influencing reverse stitching. Suitable indicia 41 may be arranged on the transparent insert above the feed reversing button to identify the purpose of this element for a machine operator.

Referring to FIGS. 2 and 3 which illustrate in greater detail the feed reversing button 40, and the elements associated therewith, it will be apparent that a closure member 42 is secured to the back of the escutcheon plate 21 and a switch base plate 43 is constrained therebetween. Carried on the switch base plate in alignment with the feed reversing button 40 is an electric switch 44 preferably comprising a pair of contacts 45 and 46 extending through the base plate and covered by a dished shaped electric conducting resilient disc 47. The disc is mounted on a support strip 48 arranged to abut the base plate. The rim of the disc is constantly in engagement with the contact 45 but when uninfluenced by depression of the button 40, the disc 47 remains bowed and out of engagement at the center with the contact 46 as shown in FIG. 2. When depressed by contact of the button, the disc 47 snaps into a position closing an electrically conductive path between the contacts 45, 46 as shown in FIG. 3. Leads including an electrically conductive lead 49 may be arranged connecting the contacts 45, 46, from a ground and as shown in FIG. 4 to a voltage source 50 and then to an inverter 51. When the feed reversing switch is closed, a low or 0 signal will appear as indicated at XX on the input side of the inverter 51 and a high or 1 signal will appear as indicated at RR at the output side of the inverter 51.

Referring to FIG. 4 the influence on the sewing machine of closure of the feed reversing switch 44 will now be described.

Briefly reviewing those features of the logic diagram of FIG. 4 which remain substantially unchanged from those of the disclosure of U.S. Pat. No. 3,872,808, the pattern selector means 90, depending upon the setting of a switch 70 and depending upon which pattern selection button is depressed, results in appearance of a selected digital code signal continuously on output lines 72, 73, 74, 75 and 76 from the latch 69 and also results in a pulse being generated in the line 139 from the one shot 66. In the address memory 91, the digital code signal on lines 72 to 76 results in an output on lines 80 to 87 which continuously defines the starting word address of a group of consecutive word addresses in the Pattern ROM 92 constituting a stitch pattern. The address counter 93 is responsive to pulses on the line 104 consecutively to increase the address appearing on lines 95 to 103 leading to the ROM 92. In the U.S. Pat. No. 3,872,808 a pulse on the line 138 leading to the address counter was required to reset the counter to the starting word address appearing on lines 80 to 87 and as disclosed in U.S. Pat. No. 3,872,808, this was occasioned either by a pulse in line 139 resulting from selection of a new pattern or upon the appearance of a special end-of-pattern code word on the output lines 110 to 114 from the ROM 92. In the U.S. Pat. No. 3,872,808, the bight output lines 110 to 114 and the feed output lines 115 to 119 from the ROM 92 are shown leading directly to the bight and feed actuating means, respectively.

Referring to FIG. 4, it will be observed that the bight output lines 110 to 114 in the present invention do not lead directly from the pattern ROM 92 to the bight actuating means, but are instead directed to an auxiliary memory unit 150. The auxiliary memory unit 150 stores one pattern of stitch bight information corresponding, for instance, to center needle position, which is applied to output lines 160 to 164 leading to the actuating means whenever a signal is applied to the line 166 leading to the auxiliary memory unit 150. In the absence of a signal on line 166, the auxiliary memory unit 150 will pass to the lines 160 to 164 the stitch pattern information received on lines 110 to 114.

As illustrated, the output side RR of the inverter 51 which is connected to the feed reversing switch 44, is connected as an input to an OR gate 151 of which the output is connected to the signal line 166 of the auxiliary memory unit 150. With this arrangement, whenever the feed reversing button 40 is depressed, the needle will be shifted to a given fixed lateral position, preferable to center needle position.

The feed output lines 115 to 119 in the present invention similarly are not directly connected to the feed actuating means but instead each includes an open collector in the form of a NAND gate 170. One input of each of the NAND gates 170 is connected to the output of an NOR gate 175 of which one input is supplied by a line 176 from the output side RR of the inverter 51, and since the output side RR will carry a signal whenever the feed reversing switch is closed, the feed pattern information will then be interrupted by the open collectors 170. The signal from the line RR will also be delivered via line 172 to an auxiliary memory unit 180 which stores one pattern of feed magnitude and direction information corresponding preferably to a reverse direction of feed of appreciable magnitude, for instance twelve stitches to the inch in a reverse direction. Whenever the feed reverse button is depressed, therefore, the feed mechanism of the sewing machine will no longer respond to the feed control pattern information from the main ROM 92 but instead will be influenced by the output lines 195 to 199 from auxiliary memory unit 180 to dictate a work feed condition corresponding to that of a reverse feed while the feed reversing button is held depressed.

As shown in FIG. 4, the address counter 93 differs from that disclosed in U.S. Pat. No. 3,872,808 in that in the present invention a signal, i.e. a high or 1 condition, on line 138 will permit the counter to count, and upon interruption of the signal on line 138, i.e. a low or 0 condition, will cause the counter to reset to whichever beginning-of-pattern number is continuously impressed thereon by the lines 80 to 87 from the address memory. The AND gate 135 and the OR gate 137 which respond, respectively, to the end-of-pattern signal and to selection of a new pattern, in the present invention, supply input to a NOR gate 140 the output of which is connected to the reset line 138 of the address counter 93.

Another input to the NOR gate 140 is the output of an OR gate 141. A signal appearing at either input to OR gate 141 will cause resetting of the counter. The lead 142 is from a circuit influenced by means with which the present invention is not concerned. The lead 143 is the output of a flip-flop comprising two NOR gates 145 and 146 connected as shown. One input to the flip-flop is connected to the line RR on the output side of the inverter 51 which remains in an off or 0 condition during normal stitching and carries a signal only during depression of the reversing feed button. The other input to the flip-flop is from a circuit including an OR gate 147 and an AND gate 148. One of the inputs to the OR gate 147 is the output of the AND gate 148 which has two inputs, one from the line 104 during arm shaft timing pulses, and the other from line XX which carries a signal only while the feed reverse switch is open.

During normal sewing operations, therefore, and when the feed reverse switch remains open, the address counter will remain effective during the entire sequence of addresses for which the selected pattern of stitches involves and will be reset only upon receipt of an end-of-pattern signal from the AND gate 135 or upon receipt of a signal on line 139 when a new pattern has been selected. The output of the flip-flop will remain low while there is no signal on the line RR. The absence of a signal on the line RR and on the line 190 in the flip-flop will result in a signal being generated in the line 191 of the flip-flop during normal sewing operations and because of this, signals directed to the flip-flop from the OR gate 147 will have no effect. Upon closure of the feed reverse switch, however, a signal on the input to the flip-flop in line RR will cause the output of the flip-flop to change this giving rise to an output signal which will be directed to the address counter causing it to be reset and this condition will persist while the feed reverse switch is held closed. Upon opening of the feed reverse switch, the input to the flip-flop supplied by the OR gate 147 can become effective and since the line XX supplying the AND gate 148 will carry a signal, the next receipt of an arm shaft timing pulse signal on the AND gate 148 will trigger the flip-flop shifting its output to an off condition again conditioning the address counter for normal operation.

It will be appreciated from the above that upon each closure of the feed reverse switch 44, not only will the stitch length and direction be shifted to that of a reverse feed mode, but the sewing machine will revert to straight stitching preferably in center needle position, and further more, whichever stitch pattern had been effective will be interrupted. When the feed reverse switch is again opened, that stitch pattern which had been interrupted will be reinstated at the beginning of the stitch pattern.

It is also pointed out that the present invention is advantageous in that the above described changes in the mode of operation of the machine will be accomplished utilizing the identical means which is used during normal stitch operations, the change being influenced by a substitution of stitch pattern influencing signals thus providing for profound changes in the operation of the sewing machine without the necessity for the provision of complicated parallel sets of actuating and control mechanisms.

Having set forth the nature of this invention, what is claimed herein is:

1. A sewing machine having a first electronic memory means for producing electronic pattern information signals which influence the stitch configuration to produce an ornamental stitch pattern, an arrangement for providing on command of the sewing machine operator a predetermined stitch configuration, comprising a manually operable electric switch means on said sewing machine, auxiliary electronic memory means having stored therein means for generating electronic signals dictating said predetermined stitch configuration, means rendered effective during manual operation of said manually operable electric switch means for interrupting said pattern information signals and substituting therefor said signals dictating said predetermined stitch configuration, means rendered effective upon termination of manual operation of said manually operable electric switch means for reestablishing effectiveness of said pattern information signals.

2. A feed reversing arrangement for a sewing machine having a first electronic memory unit for producing a series of successive electronic pattern information signals which influence the stitch configuration to produce an ornamental stitch pattern, said feed reversing arrangement comprising a manually operated electric switch means on said sewing machine, an auxiliary electronic memory unit having stored therein means for generating reverse feed dictating information signals, and means rendered effective during manual operation of said manually operated electrical switch means for rendering effective the information signals from said auxiliary memory unit in place of the electronic pattern information signals as the input to the ornamental stitch pattern system of said sewing machine.

3. A feed reversing arrangement as set forth in claim 2 in which said auxiliary electronic memory unit has stored therein means for generating predetermined fixed needle bight dictating information signals in addition to said reverse feed dictating information signals.

4. A feed reversing arrangement as set forth in claim 2 including means rendered effective by reopening of said manually operated electrical switch means for reestablishing said electronic pattern information signals as the input to the ornamental pattern system of said sewing machine with the first of said series of successive electronic pattern signals effective.

* * * * *